United States Patent [19]

Schillinger et al.

[11] 4,265,366

[45] May 5, 1981

[54] DISPENSING CONTAINER

[75] Inventors: Joseph F. Schillinger, Morrison; Arthur R. Nielsen, Hickory Hills, both of Ill.

[73] Assignee: Champion International Corporation, Stamford, Conn.

[21] Appl. No.: 96,504

[22] Filed: Nov. 21, 1979

[51] Int. Cl.[3] ..... B65D 85/48

[52] U.S. Cl. ..... 221/33; 206/449; 229/17 S

[58] Field of Search ..... 206/494, 449; 221/33, 221/45; 229/17 S; 312/50

[56] References Cited

U.S. PATENT DOCUMENTS

| | | | |
|---|---|---|---|
| 1,748,846 | 2/1930 | McColl | 229/17 S |
| 3,195,772 | 7/1965 | Buttery | 221/33 |
| 3,583,597 | 6/1971 | Buttery | 221/33 |

*Primary Examiner*—Allen N. Knowles

*Attorney, Agent, or Firm*—Evelyn M. Sommer

[57] ABSTRACT

An improved container for dispensing a plurality of individual sheets of material includes front, rear, top, bottom and end walls joined together to form an enclosure provided with an elongate dispensing opening in the top thereof. A platform panel is hingedly connected to the front wall adjacent the dispensing opening and extends rearwardly downward from the dispensing opening to a position slightly spaced from the rear wall to define a slot between the rear edge of the platform panel and the rear wall. A product comprising a plurality of stacked, individual sheets is supported in an elevated position by the platform panel, one edge of each of the sheets extending through the slot near the rear wall. A support panel hingedly connected between medial sections of the bottom panel and the inclined retaining panel form a compartment communicating with the slot and dispensing opening within which a portion of the sheets are disposed. The container is constructed from a blank comprising a single sheet of paper stock which can be folded into a tube that can be collapsed to facilitate shipping or storage thereof.

7 Claims, 14 Drawing Figures

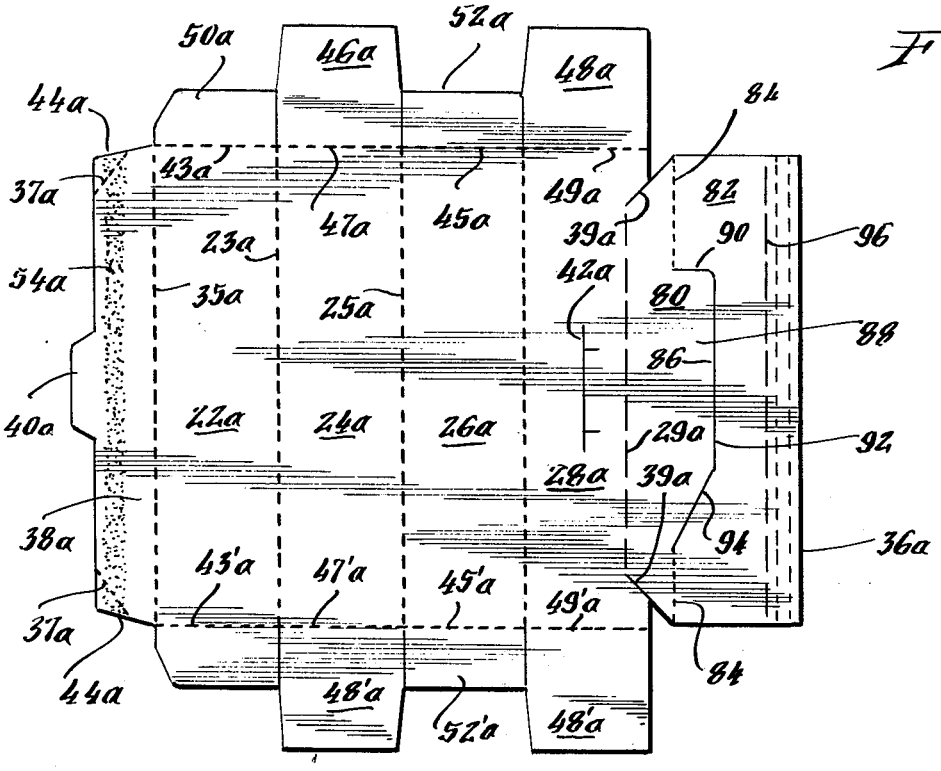
Fig. 8.
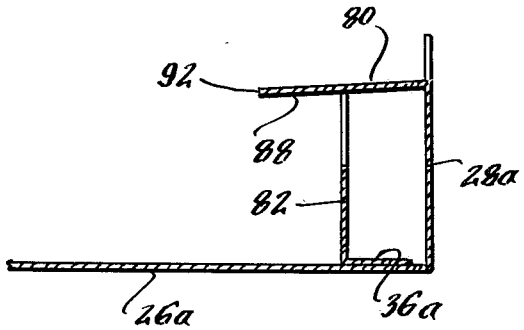
Fig. 10.
Fig. 9.
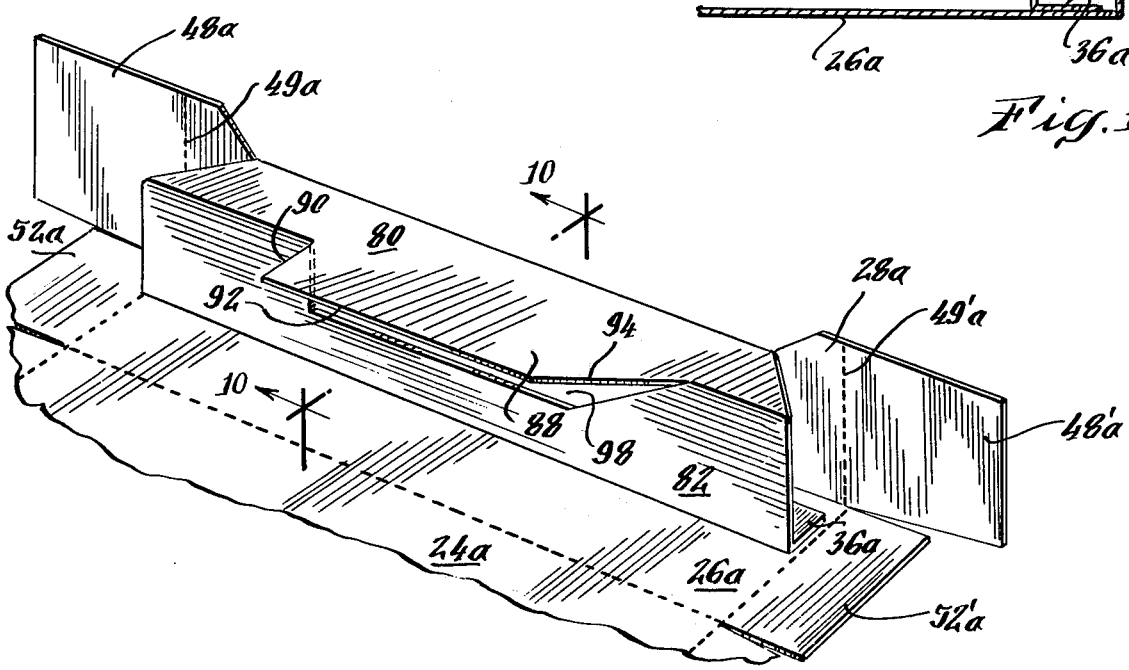

DISPENSING CONTAINER

TECHNICAL FIELD

This invention generally relates to packaging containers, and deals more particularly with a collapsable container particularly adapted for individually dispensing a plurality of sheets of a flexible product.

BACKGROUND AND BRIEF DESCRIPTION OF THE INVENTION

Various types of consumer products are manufactured in the form of sheets of cloth-like material. For example, one new consumer product of this type may be included with clothes in an automatic drying machine and functions to "soften" the fabric of the clothes being dried. These flexible sheets of "fabric softeners" are most often produced in a continuous sheet of material having preformed lines of weakness at spaced intervals therealong and is normally formed into the shape of a roll.

One class of prior art containers for containing and dispensing a roll of sheet type fabric softeners merely comprises an elongate enclosure including top, bottom, front, and rear side walls forming a tube having the opposite ends thereof enclosed by closure flaps. The roll of material is held captive between opposing walls of the container while the end of the sheet of the material is trained out through a dispensing opening in one of the container walls. As the consumer pulls the end of the roll of material out through the dispensing opening, the roll frictionally engages the container walls, and in some cases, because of the adherence between adjacent layers of the material on the roll, difficulty is encountered in causing the material to properly unroll. Moreover, some problems are encountered in tearing individual sheets from the roll since the sheet of material adjacent the sheet to be removed remains somewhat curled upon the roll so that separation between such sheets is sometimes difficult.

Another type of prior art container suitable for dispensing the same type of product includes a platform within the container which supports the stack of sheets in a curled, elevated attitude to facilitate ease of dispensing. For reasons which will be discussed infra, this type of prior art container was less than completely satisfactory from the standpoint of manufacturing economy.

The present invention overcomes the difficiencies discussed above inherent in the prior art container by forming the sheets individually in a stack thereof and providing an enclosure that not only facilitates removal of individual ones of the sheets from the enclosure, but also maybe collapsed prior to filling the same with product for shipping and storage purposes. According to the present invention, a blank comprising a single sheet of paper stock includes a plurality of essentially rectangular, side-by-side panels separated by parallel fold lines which define a front, rear, top and bottom closure panel that may be formed, by folding, into a tube. The top panel is hingedly connected to the rear panel and may be swung upwardly to reveal an elongate dispensing opening. A platform panel is hingedly connected to the front wall panel along the dispensing opening and extends rearwardly downward within the tube, the rearward edge of the platform panel being spaced slightly from the rear wall panel of the tube to define a slot within the tube. A support panel hingedly connected to medial portions of the bottom panel of the tube extends vertically from the latter and is hingedly connected to the platform panel for supporting the latter. The support panel, in combination with rearward portions of the platform panel along with the bottom panel and rear panel of the tube define a storage compartment within which a portion of a plurality individual, stacked sheets of material may be contained in a curled elevated attitude. One edge of the stack of sheets is trained upwardly through the slot near the rear of the container and forwardly toward the dispensing opening to allow a user access thereto. The platform panel slidably engages and supports a major portion of the stack adjacent the dispensing opening in a manner which facilitates dispensing individual sheets from the stack. A plurality of closure panels hingedly connected to the opposite extremities of the tube may be folded after inserting a product into the tube in order to enclose the ends of the tube and form the fully erected container. The rearward portion of the platform panel is formed from a cutout in the supporting panel to enhance manufacturing economy.

BRIEF DESCRIPTION OF THE DRAWINGS

In the drawings, which form an integral part of the specification and are to be read in conjunction therewith, and in which like reference numerals designate like parts in the various views:

FIG. 8 is a plan view of a novel blank comprising a single sheet of paper stock used in producing the container which forms the preferred embodiment of the present invention;

FIG. 9 is a perspective view of the blank of FIG. 8, depicting an intermediate step in the folding thereof into an erected container;

FIG. 10 is a fragmentary, cross-sectional view taken along the line 10—10 in FIG. 9;

DETAILED DESCRIPTION OF THE INVENTION

Figure 1:
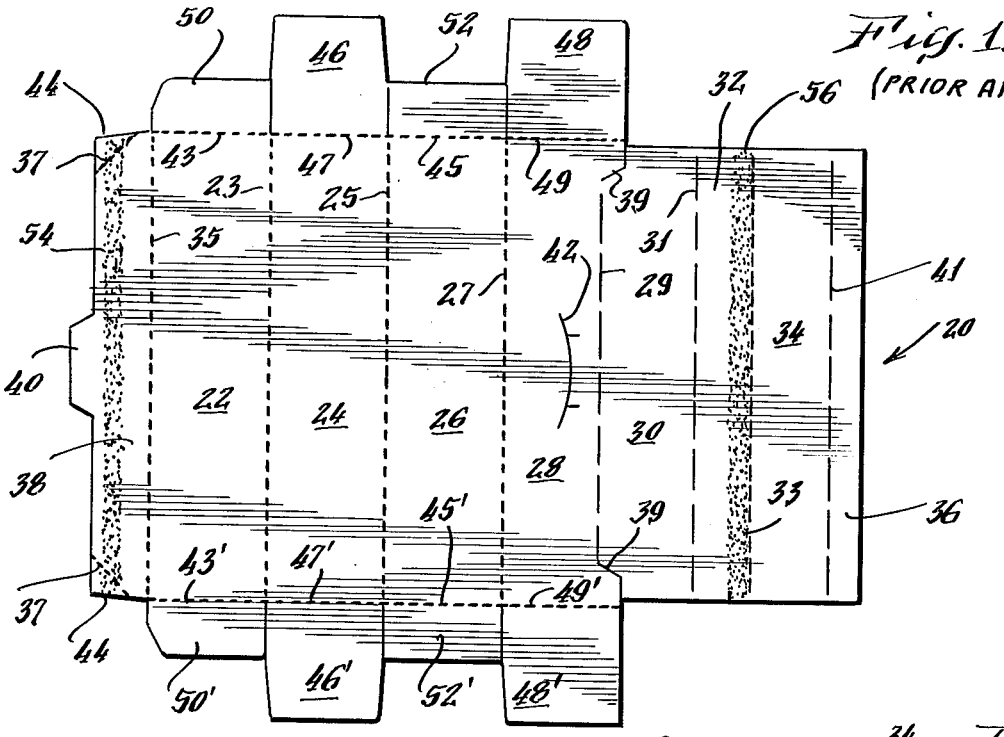
Fig. 1. (PRIOR ART)
FIG. 1 is a plan view of a prior art blank comprising a single sheet of paper stock used in producing a prior art container.
Figure 2:
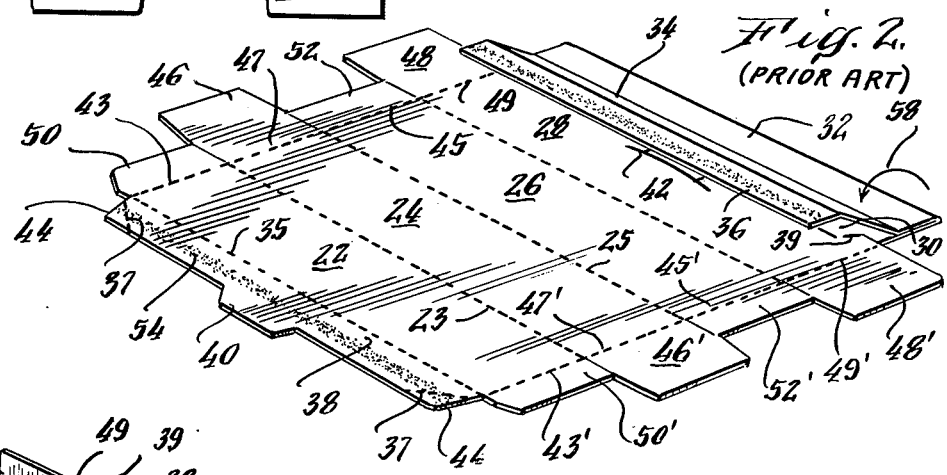
Fig. 2. (PRIOR ART)
FIGS. 2 and 3 are perspective views of the blank of FIG. 1, depicting preliminary steps in folding the prior art blank to form the prior art container.

Attention is first directed to FIGS. 1-7 wherein a prior art container and blank therefor are depicted. As shown in FIG. 1, a blank 20 for forming the prior art container includes a top panel 22, rear panel 24, bottom panel 26, front panel 28, platform panel 30, connecting panel 32, and support panel 34, disposed in side-by-side relationship to each other and respectively separated by parallel fold lines 23, 25, 27, 29, 31 and 32. An essentially rectangularly shaped dispensing flap 38 has one side thereof connected by fold line 35 to one edge of top panel 22. Dispensing flap 38 includes a pair of perforated, diagonally extending score lines 37 on opposite outer corners thereof which define triangular corner tabs 44. A locking tab 40 is provided along central stretches of dispensing flap 38 and extends outwardly from the latter.

In the preferred form, fold line 29 comprises a plurality of spaced cut-lines in the blank 20 and includes offset sections as at 39 whereby one side of the platform panel 30 extends slightly into intermediate regions of the front panel 28.

A rectangularly shaped mounting flap 36 has one edge thereof joined by a fold line 41 along the corresponding edge of the support panel 34. Top panel 22 has a pair of essentially rectangularly shaped tuck flaps 50 and 50′ respectively connected to the opposite ends thereof by fold lines 43 and 43′, while bottom panel 26 similarly has rectangularly shaped tuck flaps 52 and 52′ joined along the opposite extremities thereof by fold lines 45 and 45′. Rear panel 24 includes a pair of rectangularly shaped closure panels 46 and 46′ joined along opposite extremities thereof by fold lines 47 and 47′ while front panel 28 similarly has closure panels 48 and 48′ joined along the opposite extremities thereof by corresponding fold lines 49 and 49′.

Dispensing flap 38 preferably will include a longitudinally extending glue strip 54 of suitable adhesive material applied on one face thereof, while a like glue strip 56 is applied to the connecting panel 32 immediately adjacent the fold line 33.

Front panel 28 includes an arcuately shaped cut-line 42 therein which is essentially aligned about an axis extending perpendicular to fold lines 23, 25 and 27 and through locking tab 40.

Figure 3:
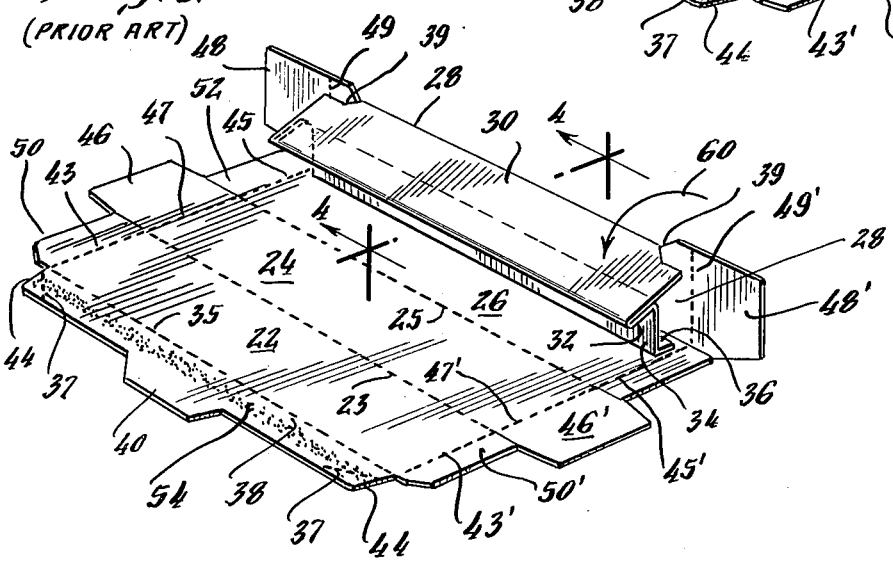
Fig. 3. (PRIOR ART)
Figure 4:
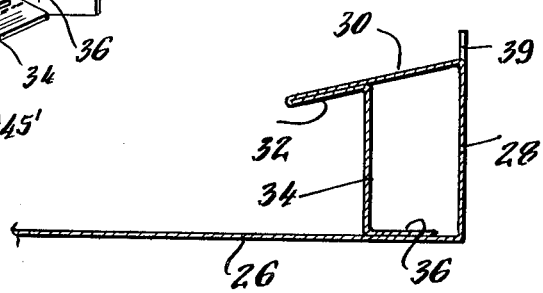
Fig. 4. (PRIOR ART)
FIG. 4 is a fragmentary, cross-sectional view of forward portions of the partially erected, prior art blank taken along the line 4—4 in FIG. 3.

Referring particularly now to FIGS. 2, 3, 4 and 5, the first step involved in folding the prior art blank 20 consists of folding the connecting panel 32 180°about fold line 31 into overlapping, abutting relationship to the platform panel 30, in the direction of the arrow 58. Platform panel 30 and front panel 28 are then respectively pivoted 90°about fold lines 29 and 27 in the direction of the arrow 60 simultaneously, while the mounting flap 36 is folded about fold line 41 in a direction opposite arrow 60 whereupon mounting flap 36 is glued to the interior face of bottom panel 26 immediately adjacent fold line 27, as best seen in FIG. 3. At this point, as shown in FIG. 4, platform panel 30 is disposed in an inclined position and extends rearwardly downward from the front panel 28. Connecting panel 32 underlaps, and abuttingly engages essentially the entire length of one lower side of the platform panel 30 while support panel 34 extends perpendicularly upward from the bottom panel 26 and supports medial areas of the platform panel 30 along essentially the entire length of the latter.

Figures 5, 6, 7, 11, 12, 13, 14:
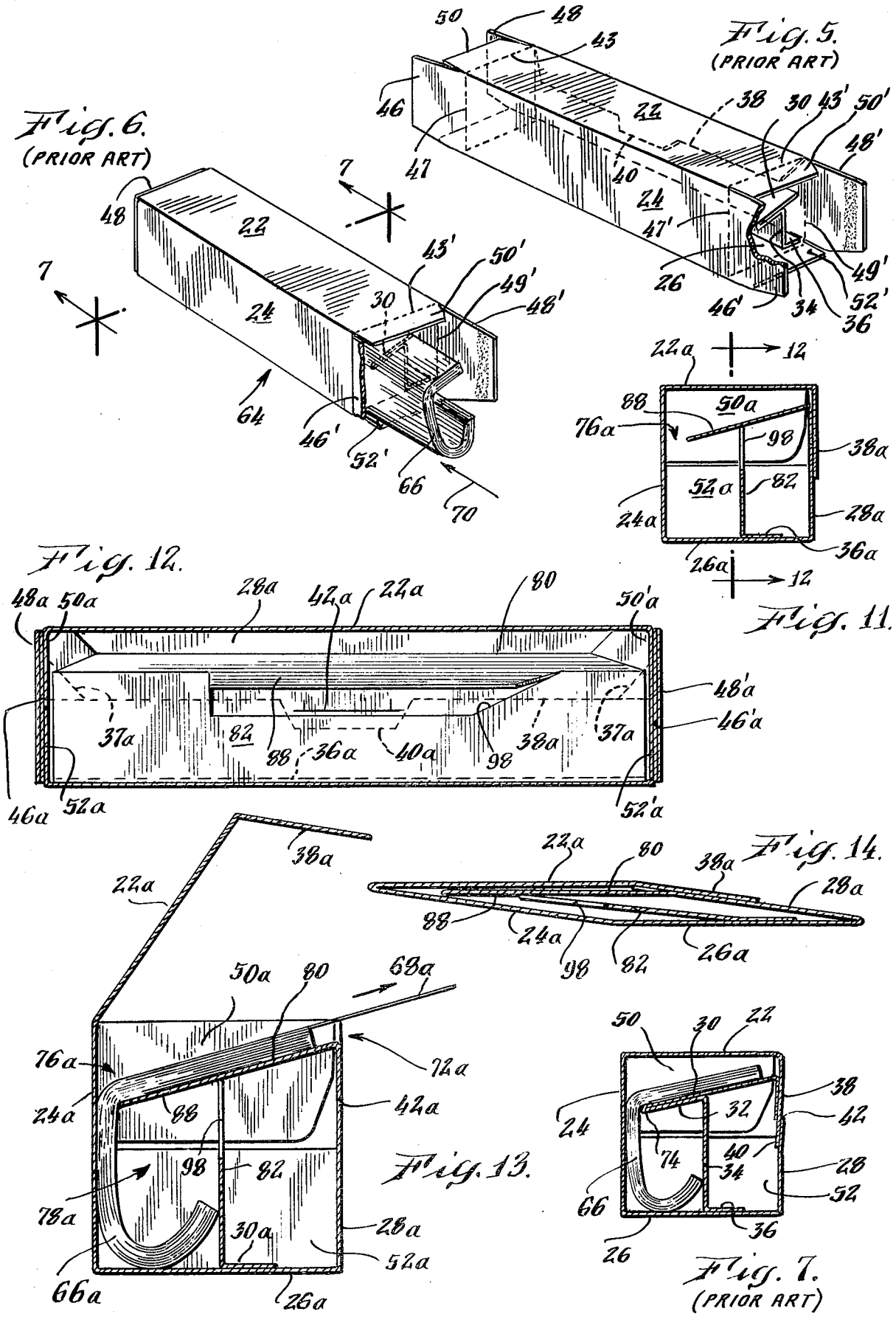
Fig. 5. (PRIOR ART)
Fig. 6. (PRIOR ART)
Fig. 7. (PRIOR ART)
FIG. 5 is a perspective view of a prior art tube formed from folding the prior art blank of FIG. 1, parts of one of the closure flaps thereof being broken away to reveal the construction of the platform and support panels within the tube.
FIG. 6 is a view similar to FIG. 5 but showing one end of the prior art tube having been closed, and a stack of sheets of material being inserted into the opposite end of the prior art tube in the direction of the arrow.
FIG. 7 is a cross-sectional view taken along line 7—7 in FIG. 6.
FIG. 11 is a cross-sectional view of the container of the present invention formed from the blank shown in FIG. 8, in a fully erected form and empty of product.
FIG. 12 is a sectional view taken along the line 12—12 in FIG. 11.
FIG. 13 is a cross-sectional view similar to FIG. 11, but taken on a larger scale and showing the container filled with product, with the dispensing flap thereof in an opening position and showing the top most sheet of material being removed from the stack thereof in the direction of the arrow.
FIG. 14 is a cross-sectional view of the tube of the present invention shown in an essentially collapsed condition.

The next step in the folding procedure consists of folding the rear panel 24 about fold lines 25 until the rear panel 24 extends perpendicularly upward from the bottom panel 26. The top panel 22 is then pivoted 90° forwardly toward the front panel 28. Finally, the dispensing flap 38 is folded downwardly and is adhesively joined to upper sections of the outer face of front panel 28 by means of glue strip 54. At this point, the prior art blank 20 has been formed into a tube 62 as shown in FIG. 5. The tube 62 may then be filled with product as will be discussed below, however, the tube 62 may be collapsed from its erected position in which the top, rear, bottom and front panels 22, 24, 26 and 28 form a structure having an essentially rectangular cross-section, to a collapsed, essentially flat position. As the tube 62 is collapsed to a storage position, top panel 22 swings into overlapping relationship to the rear panel 24 while front panel 28 likewise swings into overlapping relationship to the bottom panel 26.

Simultaneously, platform panel 30 pivots about fold line 29, the opposite edges of support panel 34 respectively pivot about fold lines 33 and 41 whereby platform panel 30 and connecting panel 32 are sandwiched between the top panel 22 and rear panel 24, while a substantial portion of the support panel 34 and mounting flap 36 are sandwiched between the front panel 28 and bottom panel 26. With the tube 62 in its collapsed, essentially flat condition, a number of the tubes 62 may be conveniently stacked upon each other for shipping or storage in a manner which requires minimal space requirements.

Referring now also to FIG. 6, with the prior art blank 20 having been formed into the tube 62, prior to filling the latter with product, one end thereof is closed by first simultaneously pivoting the respectively associated tuck flaps, such as 50 and 52 over one open end of the tube 62, and the corresponding closure panels, such as 46 and 48 are then successively folded over the tuck flaps 50 and 52, the last-to-be-folded closure panel being suitably secured as by gluing, to the first to be folded closure panel, thereby enclosing one end of the tube 62 to form the prior art container, generally designated by 64 in FIG. 6.

The prior art container 64 is then filled with a product comprising a plurality of individual, rectangularly shaped, flexible, sheets 68 of material disposed in superimposed relationship to each other to form a stack thereof indicated by the numeral 66. The stack 66 is folded into a generally L-shaped geometry and is then moved longitudinally in the direction of the arrow 70 into the open end of the prior art container 64 on opposite sides of the platform panel 30.

While the stack 66 of sheets 68 is being inserted into the container 64, the major planar portions of such sheets are trained over the platform panel 30 and supported by the latter, whereby the free outer edge of each of the sheets 68 is disposed adjacent the dispensing opening 72 in the front panel 42. The tuck flaps 50′ and 52′ are then folded over the remaining open end of the container 64 followed by the successive folding of closure panels 46′ and 48′ and gluing of one of the latter to complete the folding of the container 64 and filling thereof.

With the container 64 fully erected (as best seen in FIG. 7), the platform panel 30 has one edge thereof hingedly connected to the front panel 28 adjacent the elongate dispensing opening 72 which extends essentially the entire length of the front panel 28. Platform panel 30 extends rearwardly toward the rear panel 24 and downwardly whereby to provide an inclined surface opposing the interior face of the top panel 22. The lower, rear edge 74 of the platform panel 30 extends essentially the entire length of the container 64 and is slightly spaced from the rear panel 24 whereby to define an elongate slot 76. The lower face of connecting panel 32 along with support panel 34, rearward portions of the bottom panel 26 and the lower portions of rear panel 24 form a compartment 78 within which a portion of the edges of sheets 68 are contained. As best seen in FIG. 7, the stack 66 of sheets 68 assumes an L-shaped configuration within the container and essentially circumscribes the lower, rearward portions of the platform panel 30. Platform panel 30 provides a platform like surface for supporting the stack 66 in an elevated position adjacent the dispensing opening 72, while the compartment 78 provides a space within which lower curled edges of the stack 66 are contained.

While the prior art container described above is generally acceptable in function, it is less than completely satisfactory from the standpoint of manufacturing economy. For example, note that connecting panel 32 serves no useful function other than to provide a hinge between the platform panel 30 and the support panel 34. The present invention is concerned with providing a blank and container similar in overall construction and function to the above discussed prior art container, but which eliminates the need for employing the connector panel 32.

Attention is now directed to FIGS. 8–14 wherein the preferred embodiment of the improved container and blank therefor of the present invention are shown. As indicated previously, the overall construction of the blank and container of the present invention is similar to the prior art blank and container already described, consequently, those parts of the container of the present invention which are essentially identical to those already described with reference to the prior art container will be designated by the same reference numerals followed by the letter "a".

As shown in FIG. 8, a platform panel 80 has one lateral edge thereof hingedly connected to the front panel **28*a* by fold line 29*a*, the opposite lateral edge thereof being hingedly connected directly to the support panel 82 along spaced fold lines 84. Adjacent extremities of spaced fold lines 84 are connected by a cut line 86 which extends irregularly away from fold line 29*a* and defines an extension 88 along one lateral edge of the retaining panel 80. Extension 88 includes a first edge 90 extending essentially perpendicularly away from the adjacent fold line 84, a second edge 92 which extends perpendicular to first edge 90, and a third edge 94 which extends diagonally between second edge 92 and the adjacent spaced fold line 84. A mounting flap 36*a* is hingedly connected along the outer edge of support panel 82 by fold line 96**.

The blank shown in FIG. 8 is erected in a manner essentially identical to that described previously with reference to the prior art blank shown in FIG. 1. As the mounting flap **36*a* is pivoted 180° into abutting relationship to the bottom panel 26*a*, panel 82 pivots 90° about spaced fold lines 84 with respect to platform panel 80, thereby pivoting the extension 88 outwardly away from the support panel 82 to form a cut-out 98 in support panel 82. In the erected state, it can be appreciated that the extension 88 forms the lower, rear portion of the platform panel 80 and is supported in the desired attitude by the vertically extending portions of the support panel 82 on opposite sides of the cut-out 98 which are joined to the platform panel 80 by the spaced fold lines 84. Hence, the need for connecting panel 32 of the prior art container previously discussed is eliminated as is the need for applying adhesive to panel 32 in order to bond the same to platform panel 30** to form a two-ply construction.

The container of the present invention functions to allow dispensing of product in a manner essentially identical to the prior art container. A user opens the container **64*a* to gain access to the product therein by first lifting the corner tabs 44*a* away from the outer face of the front panel 28*a* to permit gripping the corners of the dispensing flap 38*a*. The dispensing flap 38*a* along with the top panel 22*a* is then pivoted away from the front panel 28*a* thereby revealing the dispensing opening 72*a* in upper regions of the front panel 28*a*. The user grasps the top most sheet 68*a* in the stack 66*a* thereof adjacent the dispensing opening 72*a* and the pulls such top most sheet 68 out of the container 64*a*. As the top most sheet 68*a* is being dispensed from the container 64*a*, the extension 88 of the platform panel 80 functions to hold the remaining sheets 68 in the stack 66 thereof in a stationary position between the platform panel 80 and the rear wall 24, thereby facilitating one-at-a-time removal of the sheets 68*a* from the container. The inclination of the platform panel 80 functions to encourage sliding separation of the sheets 68*a* in the stack 66*a* thereof by preventing frictional binding between the sheets 68*a* near the rear edge of the platform panel defined by the extension 88**.

After the desired number of the sheets **68*a* have been removed from the container 64*a*, the latter may be closed and locked by inserting the locking tab 40*a* into the cut-line 42*a* in the front panel 28*a* thereby holding the dispensing flap 38*a* tightly against the front panel 28*a* to prevent accidental loss of the sheets 68*a* from the container 64*a***.

The container shown in FIGS. 11–14 is collapsable in a manner identical to that of the prior art container previously described. As shown in FIG. 14, upon collapse, platform panel 80 pivots about spaced fold lines 84 into overlapping, face-to-face abutment with the support panel 82 while extension 88 extends beyond the edges defined by spaced fold lines 84 and is sandwiched between top panel **22*a* and rear panel 24*a***.

It can be appreciated that the single ply platform panel 80 which includes an extension 88 formed from a section of the support panel 82 is considerably more cost effective, from a manufacturing standpoint, than the use of a double ply platform panel construction of the prior art container. It is to be recognized that the extension 88 may assume various forms of geometry, however, the irregular form disclosed herein which is disposed in the intermediate section of the rear edge of platform panel 82 has been found to be particularly suitable in facilitating loading of the product and also aids easy dispensing of the product.

It will be observed that the present improved container not only provides for the reliable accomplishment of the object of the invention, but does so in a simple and particularly effective manner. It is recognized, of course, that those skilled in the art may make various modifications or additions to the preferred embodiment chosen to illustrate the invention without departing from the spirit and essence of the present contribution to the art. Accordingly, it is to be understood that the protection sought and to be afforded hereby should be deemed to extend to the subject matter claimed and all equivalents thereof fairly within the scope of the invention.

What is claimed is:

1. A container for dispensing a stack of flexible sheets of material, comprising:

a front, rear, top, bottom and end walls joined together to form an enclosure having open interior areas, said enclosure including a dispensing opening therein in an upper section thereof through which individual ones of said sheets of material may be dispensed, a platform disposed within said interior areas of said enclosure and joined to certain of said walls, said platform extending essentially coextensive with said opening and having one edge thereof disposed proximal to said front wall adjacent upper portions of the latter, said platform being disposed in an inclined position extending rearwardly downward away from said front wall toward said rear wall, the opposite edge of said platform being spaced from said rear wall and defining a slot therebetween communicating with said opening, said stack of sheets being adapted to be disposed in overlaying relationship to said platform whereby to be supported at an elevated position within said enclosure adjacent said opening, portions of said stack extending through said slot into an area of said enclosure beneath said platform, and a support panel extending between said bottom wall and said platform for supporting the latter in said inclined position thereof, said opposite edge of said platform being defined by an extension formed integral with said platform, said support panel being connected to said platform by spaced fold lines on opposite lateral sides of said extension.

2. The container of claim 1, wherein said extension comprises a single-ply of paper stock.

3. The container of claim 1, wherein said support panel includes a cut-out therein corresponding in geometrical configuration to the shape of said extension.

4. A blank comprising a single sheet of paperstock for forming the container of claim 1.

5. A blank comprising a single sheet of paperstock for forming the container of claim 2.

6. A blank comprising a single sheet of paperstock for forming the container of claim 3.

7. An improved method of manufacturing a paperboard container for dispensing sheets of a flexible product, said container being of the type including a front, rear, top and bottom wall joined together to form a tubular enclosure, a dispensing opening adjacent the top of the enclosure, means for enclosing the ends of the enclosure, a platform panel connected to the front wall and extending rearwardly toward the rear wall, said platform panel being spaced from the rear wall to define a slot between said rear wall and the rear edge of said platform panel, and a support panel extending between the bottom wall and intermediate areas of said platform panel for supporting said platform panel, wherein the improvement comprises:

producing an irregularly shaped cut line in intermediate regions of a single sheet of paperstock to define said rear edge of said platform panel, bending the paperstock about a reference axis extending between the opposite extremities of said cut line therein to form said support panel and said platform panel, the rear portion of said platform panel being formed from a cut-out in said panel defined by said cut line.

* * * * *

UNITED STATES PATENT AND TRADEMARK OFFICE

CERTIFICATE OF CORRECTION

PATENT NO. : 4,265,366

DATED : May 5, 1981

INVENTOR(S) : Joseph F. Schillinger et al.

It is certified that error appears in the above—identified patent and that said Letters Patent is hereby corrected as shown below:

Column 5, line 64, before "panel 82" insert -- support --.

Signed and Sealed this

*Twelfth* Day of *January 1982*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,265,366

DATED : May 5, 1981

INVENTOR(S) : Joseph F. Schillinger et al.

It is certified that error appears in the above—identified patent and that said Letters Patent is hereby corrected as shown below:

On the title page item (73) should read -- Champion International Corporation, Stamford, Conn. and A. E. Stanley Manufacturing Co., Decatur, Ill.; part interest to each --.

Signed and Sealed this

*Eleventh* Day of *May 1982*

[SEAL]

*Attest:*

GERALD J. MOSSINGHOFF

*Attesting Officer*

*Commissioner of Patents and Trademarks*